United States Patent [19]

Reudelsterz et al.

[11] 4,404,765

[45] Sep. 20, 1983

[54] GUN BARREL INSERT

[75] Inventors: Helmut Reudelsterz, Bochingen; Gerd Kellner, Schramberg, both of Fed. Rep. of Germany

[73] Assignee: Mauser-Werke Oberndorf GmbH, Fed. Rep. of Germany

[21] Appl. No.: 249,421

[22] Filed: Mar. 31, 1981

[30] Foreign Application Priority Data

Apr. 5, 1980 [DE] Fed. Rep. of Germany ..... 8009469

[51] Int. Cl.[3] ..... F41F 17/06; F41C 21/10; F41C 21/12

[52] U.S. Cl. ..... 42/77; 102/446; 89/28 A

[58] Field of Search ..... 102/446, 444, 445, 447; 42/77, 84, 59; 89/28 A

[56] References Cited

U.S. PATENT DOCUMENTS 3,598,053 8/1971 Glater ..... 102/41

*Primary Examiner*—Charles T. Jordan
*Assistant Examiner*—Ted L. Parr
*Attorney, Agent, or Firm*—McGlew and Tuttle

[57] ABSTRACT

The improved gun barrel insert is provided in tank-borne guns, field howitzers and the like. It makes possible the use of small caliber and thus less expensive ammunition having ballistic properties of the substituted larger caliber ammunition, while maintaining the opening, closing and igniting mechanisms provided for the larger caliber firing as well as the geometry and weight of the larger caliber cartridges. True combat conditions with a correct observation of shooting regulations can thereby be simulated to a very large extent and a high accuracy in hitting targets from shooting stands or moving bases can be obtained. The provided insert accommodates both a smaller-caliber cartridge and the igniting mechanism therefor. The insert is designed as a slightly tapering rotational symmetrical adapter conformable to the cartridge chamber of the larger caliber weapon. The conical front end of the adapter bears against the mating rear portion of the barrel insert proper. Axially the adapter is held in position by the breech block without any modification.

10 Claims, 3 Drawing Figures

GUN BARREL INSERT

FIELD AND BACKGROUND OF THE INVENTION

The present invention relates in general to ballistic weapons and in particular to a new and useful large caliber gun insert which reduces the caliber of projectile fired from the gun while at the same time more closely mimicking the characteristics and operations of the gun when using full sized rounds.

Modern combat tanks carry guns which, as a rule, have calibers between 90 and 120 mm. For training the crews of such tanks, it is absolutely necessary to practice firing under most various and as far as possible true combat conditions, in addition to service practice. It is, however, understood that certain limits are set for such training. The high cost of ammunition and lack of sufficiently extensive training grounds are the main causes for such limits.

To overcome these problems or problems connected thereto, it has been known for a long time to employ tube or barrel inserts in large-caliber weapons. This makes it possible to practice with a smaller caliber ammunition which is relatively less expensive and can be used on smaller-range shooting grounds.

The use of barrel inserts however is still limited in many respects.

Since cartridges for combat tanks, thus those of calibers between 90 and 120 mm as a rule, are ignited electrically, the system-immanent opening, closing the igniting mechanism requires adaptation to the usual mechanically pyrotechnical ignition of the small-caliber ammunition. In view of the total number of combat tanks involved, such an adaptation amounts to intolerable costs which must be incurred at the start and the end of any training period.

Another limitation relates to the ballistics of the modified gun. With training of the crews under realistic conditions, which includes firing at targets in the range of about 2,000 meters from firing stands or moving positions and by day and night, no suitable smaller caliber ammunition is available as of yet.

Another drawback in the use of prior art barrel inserts is that the gun loader must practice under unrealistic conditions since the smaller caliber ammunition does not correspond to the larger caliber combat ammunition, neither in geometry nor in weight. The loader is thus trained in handling ammunition which is not equivalent to that used in actual combat.

SUMMARY OF THE INVENTION

Taking into account these limitations determined by the prior art barrel inserts, the invention is directed to an insert for larger-caliber barrels of tank-borne guns or field howitzers, which is simple in design and operation and inexpensive and makes sure that smaller-caliber ammunition having ballistic properties of the substited larger caliber ammunition and corresponding thereto to a large extent in geometry and weight can be used while maintaining the entire original system-immanent, opening, closing and igniting mechanism of the employed weapon, so that firing can be practiced with a high hitting chance rom stands as well as in motion while at the same time widely and correctly observing shooting regulations.

Accordingly an object of the present invention is to provide a small caliber cartridge assembly for a large caliber gun having a firing mechanism, a large caliber cartridge chamber and barrel with the small caliber barrel insert comprising, an adapter member adapted to be inserted into the large caliber cartridge chamber, a small caliber cartridge connected to the adapter member having a projectile adapted to be fired through the small caliber barrel insert, and firing means in the adapter responsive to the large caliber gun firing mechanism to fire the small caliber cartridge.

Another object of the invention is to provide such a small caliber cartridge assembly wherein the firing means comprises a spring loaded firing pin in the adapter member for mechanically firing a mechanical primer in the small caliber cartridge and an electric primer engaging the firing pin for moving the firing pin to ignite the mechanical primer when the electric primer is ignited by the firing mechanism of the large caliber gun.

A still further object of the invention is to provide a small caliber conversion assembly for a large caliber gun comprising a barrel insert for central insertion into a barrel of the large caliber gun having a rear face an adapter for insertion into a cartridge chamber of the large caliber gun and abutment against the barrel insert face, a small caliber cartridge connected to the adapter for firing through the barrel insert and firing means in the adapter for firing the small caliber cartridge.

The invention offers a number of remarkable advantages. The insert with the adequately designed adapter and well-considered smaller caliber ammunition is not only simple, relatively inexpensive, reliable in operation, and easy to mount and dismount, but can in addition be optimally utilized in many respects.

The adapter is a unit which is combined of a smaller caliber cartridge and the means for its ignition. The adapter does not require any change in the design or construction of the opening, closing or igniting system initially provided in the gun. This particularly solves in a quite satisfactory manner, the problem of differences in the system of cartridge priming. The smaller caliber ammunition makes it possible to make use of and best utilize smaller, local training areas and firing ranges, without difficulties and without excessive safety measures. The smaller caliber ammunition is selected to approximately correspond in its ballistic performance and hitting chances up to certain target ranges, to the 90–120 mm caliber ammunition normally used in tank-borne guns. This allows handling and firing under true combat conditions, from a stand or motion by day or night.

Obviously the smaller caliber ammunition is much less expensive than the normal large caliber ammunition required for the gun. This results in considerable savings. Such savings may then make it possible to arrange, from time to time, for a "real" firing practice, and to replace at least partly also such sorts of ammunition which require too wide a safety range.

Another object of the invention is to provide a small caliber conversion assembly and a small caliber cartridge assembly for large caliber guns which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment is illustrated.

DESCRIPTION OF PREFERRED EMBODIMENT

Figure 1:
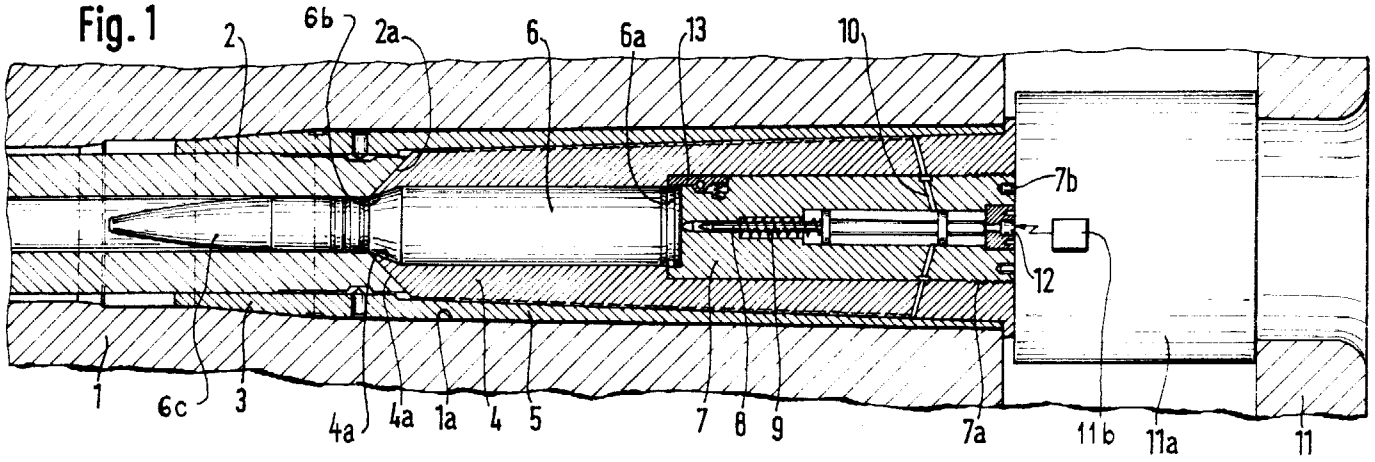
FIG. 1 is a vertical sectional view of the zone of the breech block and cartridge chamber of a combat tank-borne gun.

Turning to the drawings in particular, the invention embodied therein, in FIG. 1, comprises a small caliber conversion assembly and small caliber cartridge for a large caliber gun which utilizes an adapter that is insertable into a large cartridge chamber of the gun, the adapter carrying a small caliber cartridge and firing means for the small caliber cartridge. Such large caliber guns can be those shown as field howitzers or the like, or, in the embodiment shown, a tank-borne gun.

In the barrel 1 of a combat tank-borne gun (not shown)) an inner barrel insert 2 is received in a centered position. A fitting ring 3 is provided between the two barrels 1 and 2. The cartridge chamber 1*a* if barrel 1 accommodates a fitting protective tube 5 for receiving an adapter 4. Tube 5 may however be deleted and adapter 4 shaped to fit chamber 1*a*. Adapter 4 is intended to receive a cartridge 6 having a projectile 6*c* with caliber corresponding to that of inner barrel 2. Axially behind cartridge 6, a cylindrical part 7 is provided accommodating the firing pin 8 and a spring 9, loading the pin. Cartridge chamber 1*a* with protective tube 5, adapter 4, cartridge 6, cylindrical part 7, and firing pin mechanism 8, 9 are closed at the rear by the breech block 11*a* of a breech plate 11. the combination substitution for one full size round that would be used in the gun.

On its end receiving the cartridge 6, adapter 4 is provided with a conical shoulder 4*a*. This shoulder is conformable to a conical rear face 2*a* of inner barrel 2. This design provides both for a centering and sealing between the two parts. Adapter 4 has a recess for cartridge 6 with a conical shoulder 4*a* that centers cartridge 6 which has a conical part 6*b*.

The cartridge with adapter and firing means are assembled as follows:

Cylindrical part 7 is screwed into adapter 4 by means of a thread 7*a*. An electrical primer 12 is provided centrally in the rear of cylindrical part 7. This primer may correspond to a primer usually provided on larger caliber cartridges to be fired from barrel 1.

For firing, electrical primer 12 is ignited in a well known manner by the mechanism in breech block 11*a*, as if a full size round was in the gun. The known firing mechanism is shown schematically at 11*b*. The gas pressure thereby produced overcomes spring 9 and drives firing pin 8 against the mechanical primer of the smaller caliber cartridge 6. The gas pressure then produced is removed through venting bores 10. The cheaper small caliber cartridge 6 with mechanical primer can thus be used in a gun equipped to fire electrical primer rounds.

After the discharge, a new cartridge 6 is inserted after removing the case of the fired cartridge in the following way:

Cylindrical part 7 is unscrewed from adapter 4 by means of a pin wrench (not shown) whose pins engage circumferentially distributed bores 7*b*. A spring loaded pawl 13 which is mounted on the periphery of cylindrical part 7 and had engaged an extraction groove 6*a* at the time the just fired cartridge was inserted, withdraws the empty cartridge case simultaneously with the withdrawal of part 7. Then cylindrical part 7 accommodating firing pin 8 and spring 9 and carrying a new cartridge 6 is screwed into thread 7*a*, and a new electrical primer 12 is inserted. Advantageously, the new cartridge 6 is inserted in the above described manner in an ammunition depot and not by the training crew. A plurality of the line cartridge adapter and firing means units are supplied to each crew for use as if they were full size rounds.

The adapter 4 equipped as described is loaded upon a firing order for training or firing practice in a way which is well known to the gun loader from the handling of full caliber ammunition. This is assisted by the fact that the geometry and weight of an adapter 4 equipped with a smaller caliber cartridge 6 approximately corresponds to the geometry and weight of a full caliber catridge with which the gun loader is familiar.

Figure 2:
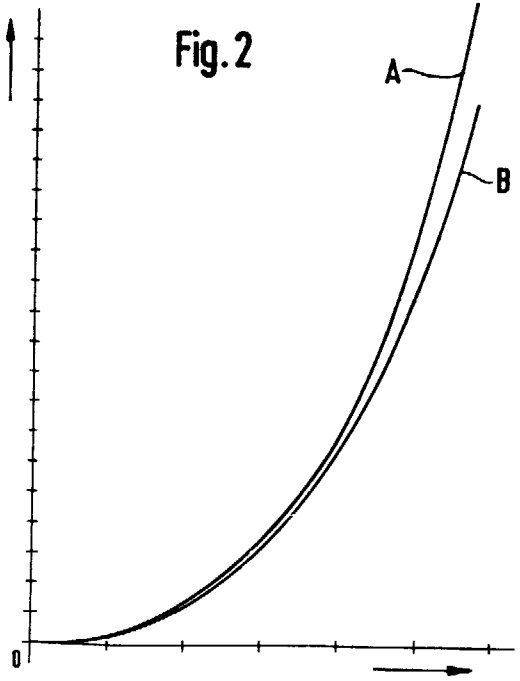
FIG. 2 is a diagram showing the maximum trajectory ordinate as a function of the firing distance, for comparable larger caliber and smaller caliber ammunition.

The diagram of FIG. 2 shows that the maximum trajectory ordinate A of a larger caliber ammunition as plotted against the firing distance, is only slightly higher than the ordinate B of a smaller caliber ammunition. By large caliber ammunition, the ammunition is understood to be such as that fired from combat tank-borne guns or field howitzers, etc. By smaller-caliber ammunition, the ammunition is understood to be that which is received in adapter 4 (FIG. 1).

Figure 3:
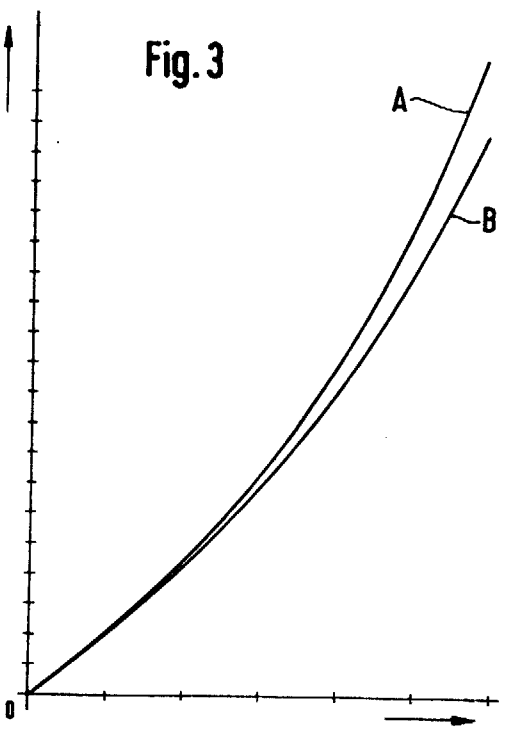
FIG.3 is a diagram showing the angle of elevation as a function of the firing distance, for comparable larger caliber and smaller caliber ammunition.

An identical or at least similar relation is found in the diagram of FIG. 3 where the angle of elevation is plotted against the firing distance and again referred to the two sorts of ammunition A and B as in FIG. 2.

It may be derived from the diagrams of FIGS. 2 and 3, that for purposes of training and practice under combat conditions, while carefully selecting a smaller caliber ammunition, about the same firing performance can be achieved as with a larger caliber ammunition for the above mentioned weapons. Such a performance, however, is achieved with substantially lower costs and, if needed, in shorter range training areas, especially local training grounds.

By slightly modifying the smaller caliber ammunition, for example, decreasing or increasing the muzzle velocity by reducing or augmenting the propellant charge in known ways, the training ammunition may still be better adapted to the larger caliber ammunition, and even a complete conformation to the parameters of the trajectories may be obtained for certain ranges.

The application of the invention of course is not restricted to combat tank-borne guns. It may equally be applied to field howitzers or the like.

While a specific embodiment of the invention has been shown and described in detail to illustrate the application of the principles of the invention, it will be understood that the invention may be embodied otherwise without departing from such principles.

What is claimed is:

1. A small caliber cartridge assembly for a large caliber gun having a firing mechanism, a large caliber cartridge chamber and barrel, comprising:

a small caliber barrel insert axially and radially fixed in the barrel;

a chamber tube inserted in the large caliber cartridge chamber;

an adapter member adapted to be inserted into said chamber tube;

a small caliber cartridge connected to said adapter member and having a projectile adapted to be inserted into and fired through said small caliber barrel insert;

said adapter member being substantially rotationally symmetrical and having a tapered outer surface tapered toward said small caliber cartridge and toward said barrel insert, said adapter member including a conical forward end extending toward said small caliber cartridge projectile, said barrel insert having a conical rear face against which said front conical end of said adapter member is adapted to bear; and firing means in said adapter member responsive to the large caliber gun firing mechanism to fire said small caliber cartridge.

2. A cartridge assembly according to claim 1, wherein said small caliber cartridge includes a mechanical primer, said firing means comprises a firing pin movably mounted in said adapter member, an electrical primer engaged with said firing pin to move said firing pin against said mechanical primer when said electrical primer is ignited, said electrical primer adapted to be ignited by the firing mechanism of the large caliber gun.

3. A cartridge assembly according to claim 2, including a cylindrical part threadably engaged into an opening in the rear end of said adapter member, said cylindrical part carrying said electrical primer and said firing pin.

4. A cartridge assembly according to claim 3, wherein said adapter member has a recess for receiving said small caliber cartridge, said cylindrical part holding said small caliber cartridge axially fixed in said recess when said cylindrical part is completely threaded into said adapter member.

5. A cartridge assembly according to claim 4, wherein said adapter member recess includes a conical shoulder, said small caliber cartridge includes a part bearing against said conical shoulder for centering said small caliber cartridge with respect to said adapter member.

6. A cartridge assembly according to claim 3, wherein said small caliber cartridge includes an extraction groove, said cylindrical part having a spring loaded pawl having a nose engaged with said extraction groove to hold said small caliber cartridge for insertion of said small caliber cartridge and cylindrical part into said adapter member and for extracting said small caliber cartridge from said adapter member.

7. A cartridge assembly according to claim 3, wherein said cylindrical part has at least one vent bore, said adapter having at least one vent bore aligned with said cylindrical part vent bore, said aligned vent bore communicating with a chamber in said cylindrical part communicating with said electrical primer for venting gases produced by said electrical primer when it is ignited.

8. A cartridge assembly according to claim 1, wherein a geometry and weight of said adapter member with small caliber cartridge and firing means is selected to correspond substantially to a geometry and weight of a large caliber cartridge for the large caliber gun.

9. A small caliber conversion assembly for a large caliber gun having a firing mechanism, a large caliber cartridge chamber and barrel, comprising:

a barrel insert for receiving a small caliber projectile inserted and centered in the large caliber cartridge barrel;

a chamber protector tube inserted in the large caliber cartridge chamber and engaged with said barrel insert for centering said barrel insert, said protective tube lining said large caliber cartridge chamber;

a small caliber cartridge assembly having an adapter member insertable into said protective tube, a small caliber cartridge having a projectile for movement through said barrel insert and firing means for firing said small caliber cartridge.

10. A conversion assembly according to claim 9, wherein said barrel insert has a conical rear face, said adapter member having a conical front face engaged with said barrel insert rear face for centering said small caliber cartridge in said barrel insert.

* * * * *